US010955119B2

(12) United States Patent
Cheng

(10) Patent No.: US 10,955,119 B2
(45) Date of Patent: Mar. 23, 2021

(54) WEARABLE ILLUMINATION APPARATUS

(71) Applicant: MOON SPORT LIMITED, Hong Kong (CN)

(72) Inventor: Wui Pan Cheng, HongKong (CN)

(73) Assignee: MOON SPORT LIMITED, N.T. (HK)

( * ) Notice: Subject to any disclaimer, the term of this patent is extended or adjusted under 35 U.S.C. 154(b) by 0 days.

(21) Appl. No.: 16/679,137

(22) Filed: Nov. 8, 2019

(65) Prior Publication Data

US 2021/0033266 A1 Feb. 4, 2021

(30) Foreign Application Priority Data

Jul. 30, 2019 (CN) ..... 201921240347.8

(51) Int. Cl.

| | |
|---|---|
| ***F21V 21/084*** | (2006.01) |
| ***F21V 33/00*** | (2006.01) |
| ***F21V 23/04*** | (2006.01) |
| ***F21L 4/02*** | (2006.01) |
| ***F21L 4/08*** | (2006.01) |
| ***F21V 23/00*** | (2015.01) |
| ***F21V 31/00*** | (2006.01) |
| ***F21V 29/70*** | (2015.01) |

(52) U.S. Cl.

CPC ..... *F21V 21/084* (2013.01); *F21L 4/02* (2013.01); *F21L 4/08* (2013.01); *F21V 23/008* (2013.01); *F21V 23/0414* (2013.01); *F21V 29/70* (2015.01); *F21V 31/005* (2013.01); *F21V 33/0008* (2013.01)

(58) Field of Classification Search

CPC ..... F21L 4/02; F21L 4/08; F21V 23/0414; F21V 23/008; F21V 31/005; F21V 33/0008

See application file for complete search history.

(56) References Cited

U.S. PATENT DOCUMENTS

| | | | | |
|---|---|---|---|---|
| 9,829,182 | B1 * | 11/2017 | McCaslin | F21V 21/084 |
| 2008/0013308 | A1 * | 1/2008 | Kang | F21L 4/00 362/205 |
| 2009/0323317 | A1 * | 12/2009 | Spartano | F21V 23/0414 362/105 |
| 2013/0265788 | A1 * | 10/2013 | O'Maley | F21L 4/00 362/477 |

* cited by examiner

*Primary Examiner* — Anabel Ton

(57) ABSTRACT

The embodiments of the present invention relate to the field of illumination technology, and in particular, a wearable illumination apparatus is disclosed, which comprises: a body, the body being bendable; and a first light source, the first light source being fixed to the body and able to be bent together with the body. The wearable illumination apparatus is provided with the first light source that is bendable; and when the wearable illumination apparatus is worn around the head of a user, the wearable illumination apparatus can be bent into the contour shape of the head of the user. In this case, the first light source forms an arc-shaped light source, so that the wearable illumination apparatus provides a wider illumination range than those of the headlamps on the market, and the user does not need to repeatedly adjust the angle of a main lamp or move the main lamp to make an illumination area of the main lamp be within a desired range by the user, thereby facilitating use of the user.

8 Claims, 5 Drawing Sheets

WEARABLE ILLUMINATION APPARATUS

FIELD OF THE INVENTION

The embodiments of the present invention relate to the technical field of illumination, and in particular, to a wearable illumination apparatus.

BACKGROUND

A headlamp is an illumination tool worn around a head, which can assist illumination when the light is insufficient or at dim night and at the same time, free wearers' hands so that they can work with both hands in such conditions, thereby effectively improving working efficiency of the wearers in the above conditions.

Currently, a common headlamp on the market generally comprises a main lamp and an elastic band used to fix the main lamp when a user wears the headlamp, wherein two ends of the elastic band are respectively connected to two ends of the main lamp, and the main lamp is worn on the middle of the forehead of the user. However, since the illumination range of the main lamp is not wide enough, the user needs to manually adjust the angle or move the position of the main lamp to illuminate a desired area by the user. This brings up a problem that manual adjustment is commonly requested across the scenarios of using a headlamp.

New apparatus that meets need of wide illumination range without manual adjustment is desirable.

SUMMARY

The present invention aims to provide a wearable illumination apparatus, so as to solve the technical problem of the current illumination range of a headlamp being not wide enough.

The following technical solution is used for solving the technical problem of the present invention:

a wearable illumination apparatus, comprising;

a body, the body being bendable; and a first light source, the first light source being fixed to the body and able to be bent together with the body.

As a further improvement for the above technical solution, the first light source is a floodlight.

As a further improvement for the above technical solution, a second light source is comprised, the second light source being arranged at one end of the body.

As a further improvement for the above technical solution, a control assembly is comprised, the control assembly being arranged at one end of the body and comprising a first switch module, a second switch module, and a power supply, wherein the first switch module is connected to the power supply and the first light source respectively, and the second switch module is connected to the power supply and the second light source respectively.

As a further improvement for the above technical solution, the control assembly further comprises a charging module and a charging contact, and the charging module is connected to the power supply and the charging contact respectively.

As a further improvement for the above technical solution, the control assembly further comprises an installation housing, a sealing cover, and a dustproof plug, and one end of the installation housing is connected to the body;

the sealing cover covers one face of the installation housing that is away from the first light source, and an installation space is formed between the sealing cover and the installation housing;

the power supply, the charging module, and the charging contact are arranged in the installation space, and the installation housing is provided with a charging hole communicated with the outside at a position corresponding to the charging contact; and the dustproof plug is detachably installed at the charging hole.

As a further improvement for the above technical solution, the control assembly further comprises an alarm module and an electric power detection module, the electric power detection module is used for detecting electric power of the power supply, the alarm module is connected to the electric power detection module, and the alarm module is used for prompting the electric power of the power supply according to a detection result of the electric power detection module.

As a further improvement for the above technical solution, the control assembly further comprises a heat dissipation module, and the heat dissipation module is used for dissipating heat for the second light source.

As a further improvement for the above technical solution, the material of the body is silica gel.

As a further improvement for the above technical solution, a fixing band is further comprised, wherein two ends of the fixing band are respectively connected to one end of the control assembly that is far away from the body and one end of the body that is far away from the control assembly.

The beneficial effects of the present invention are as follows:

Compared with common headlamps currently on the market, the wearable illumination apparatus is provided with a first light source that is bendable; and when the wearable illumination apparatus is worn, the wearable illumination apparatus can be bent into the contour shape of the head of the user. In this case, the first light source forms an arc-shaped light source, so that the wearable illumination apparatus provides a wider illumination range than those of the headlamps on the market, and the user does not need to repeatedly adjust the angle of a main lamp or move the main lamp to make an illumination area of the main lamp be within a desired range by the user, thereby facilitating use of the user.

BRIEF DESCRIPTION OF THE DRAWINGS

One or more embodiments are exemplarily illustrated by means of corresponding accompany drawings thereof, the exemplary illustration does not constitute a limitation on the embodiments. Elements having the same reference numerals in the accompany drawings represent similar elements, and figures in the accompanying drawings do not constitute a proportional limitation unless otherwise specified.

DETAILED DESCRIPTION

For ease of understanding the present invention, the present invention is illustrated in more detail below in conjunction with the accompany drawings and specific embodiments. It should be noted that, when an element is expressed as being "fixed to"/"fixedly connected to" another element, the element may be directly located on another element or one or more intermediate elements may exist therebetween. When an element is expressed as being "connected to" another element, the element may be directly connected to another element or one or more intermediate elements may exist therebetween. The terms "vertical", "horizontal", "left", "right", "inside", "outside", and similar expressions used in this specification are merely for illustration.

Unless otherwise defined, all technical and scientific terms used in this specification have the same meaning as those commonly understood by those skilled in the art to which the present invention belongs. The terms used in the specification of the present invention are merely for the purpose of describing specific embodiments, but are not intended to limit the present invention. The term "and/or" used in this specification comprises any and all combinations of one or more relevant items listed.

In addition, the technical features involved in different embodiments of the present invention described below can be combined with each other as long as they do not constitute a conflict with each other.

In this specification, the "installation" includes fixing or limiting an element or an apparatus to a specific position or place by means of welding, screwing, engaging, bonding, and the like. The element or apparatus can remain stationary at the specific position or place or can be moved within a limited range, and the element or apparatus can be disassembled or cannot be disassembled after being fixed or limited to the specific position or place, which is not limited in the embodiments of the present invention.

Figure 1:
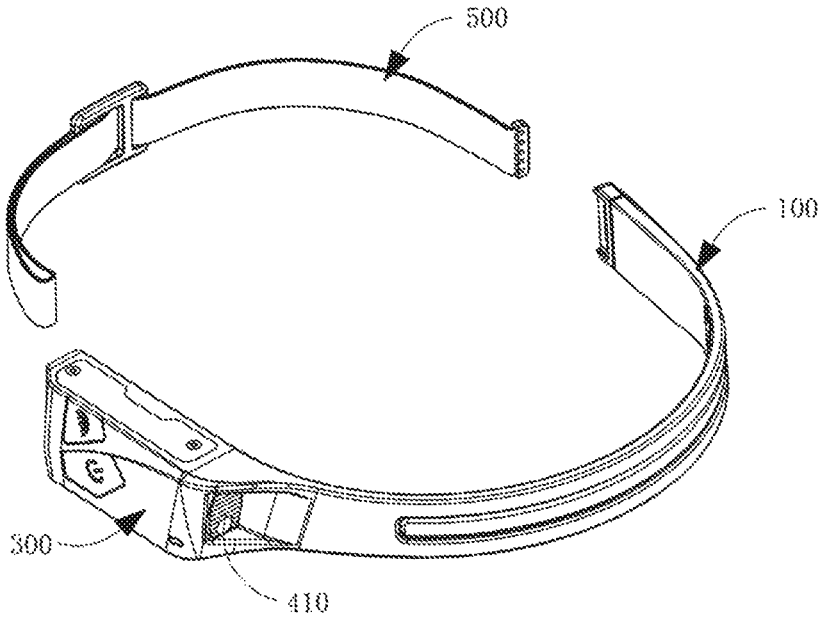
FIG. 1 is a three-dimensional schematic diagram of a wearable illumination apparatus according to one embodiment of the present invention.
Figure 2:
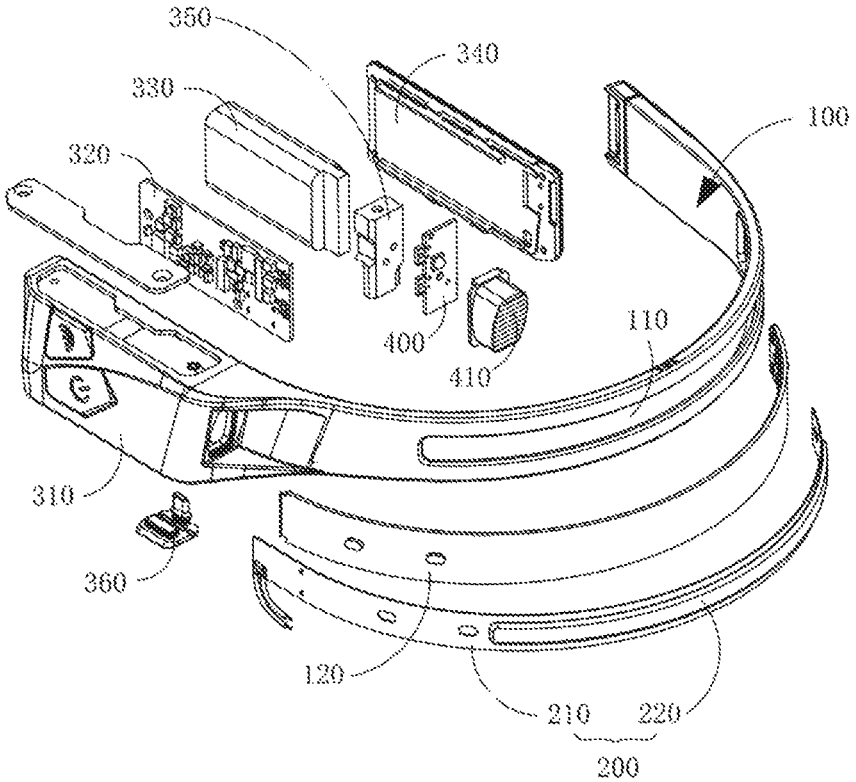
FIG. 2 is a schematic exploded diagram of a body and a control assembly in FIG. 1.

Referring to FIG. 1 and FIG. 2, the two figures respectively show a three-dimensional schematic diagram and a schematic exploded diagram of a wearable illumination apparatus in one direction according to one embodiment of the present invention. The wearable illumination apparatus comprises a body 100, a first light source 200, a control assembly 300, a second light source 400, and a fixing band 500. The first light source 200 is fixed to the body 100, the control assembly 300 is arranged at one end of the body 100, the second light source 400 is arranged at the junction of the control assembly 300 and the body 100, two ends of the fixing band 500 are respectively connected to one end of the control assembly 300 that is far away from the body 100 and one end of the body 100 that is far away from the control assembly 300.

Referring to FIG. 1 to FIG. 6 together, for the above body 100, the body 100 is generally of a flat cuboid shape, and is made of an elastic material, and two ends of the body 100 can be bent relative to the middle portion. The middle of the body 100 is provided with a long through groove 110 which extends in the length direction thereof, and the long groove 110 is used for installing the first light source 200. Preferably, the body 100 is made of a silica gel material.

For the above first light source 200, the first light source 200 is generally strip-shaped, and comprises a base portion 210 and a light emitting portion 220, and both the base portion and the light emitting portion are strip-shaped. The light emitting portion 220 is arranged at one face of the base portion 210, the light emitting portion 220 is adapted to a shape of the long groove 110, the light emitting portion 220 is embedded into the long groove 110, and the base portion 210 butts against a surface of the body 100. The first light source 200 is also elastic, and can be bent into an arc shape together with the bending of the body 100, so as to be closely attached to the head of a user.

When the body 100 is worn around the head of the user, the two ends of the body 100 are bent in a direction away from the first light source 200 with the middle portion as a reference, and the first light source 200 is synchronously bent to form an arc-shaped light source, with an illumination range thereof being larger than those of the existing main lamps on the market.

To further ensure that the first light source 200 can have a wider illumination range, the first light source 200 is preferably a floodlight.

In order to fix the first light source 200, the wearable illumination apparatus further comprises a fixing sheet 120, wherein the fixing sheet 120 butts against one face of the base portion 210 that is away from the light emitting portion 220, and at the same time, is fixedly connected to the body 100, so as to fix the first light source 200.

It can be understood that, the manner by means of which the first light source 200 is fixed to the body 100 is not limited to the manner described above, and may be other manners, for example, the base portion 210 is engaged with and fixed to the long groove 110, or the base station 210 is fixed to an inner wall of the long groove 110 by means of bonding.

For the above control assembly 300, the control assembly 300 is arranged at one end of the body 100, and comprises an installation housing 310 directly connected to the end of the body 100, a circuit control module 320, a power supply 330, a sealing cover 340, a heat dissipation module 350, and a dustproof plug 360. A confined installation space 311 is formed between the installation housing 310 and the sealing cover 340, the circuit control module 320, the power supply 330, the heat dissipation module 350, and the above second light source 400 are all arranged in the installation space 311, the installation space 311 is for preventing the circuit control module 320, the power supply 330, the heat dissipation module 350, and the above second light source 400 above from being exposed.

Specifically, the installation housing 310 is generally of a cuboid structure, one end of the installation housing is connected to the body 100, one face of the installation housing that is away from the first light source 200 is covered by the sealing cover 340, the installation space 311 is formed between the sealing cover 340 and the installation housing 310, and the installation space 311 is in a closed state.

Since the installation space 311 is relatively large, the installation housing 310 protrudes from one face of the body 100 that is away from the fixing sheet 120. One end of the installation housing 310 that is close to the body 100 is provided with a light-transmitting hole for the light emitted by the second light source 400 to pass through.

In some embodiments, the installation housing 310 and the body 100 can be of a structure integrally formed by silica gel, the silica gel can not only satisfy the above bending performance, but also have an excellent waterproof effect. In addition, the silica gel has a good skin affinity.

It can be understood that, in other embodiments of the present invention, the installation housing 310 and the body 100 may also be formed separately, and then fixedly connected to each other by means of bonding, engaging, and the like. In addition, in the case above, the material of the installation housing 310 may be inconsistent with the material of the body 100, so as to control costs; and moreover, when one of the components is damaged, the component can be detached to realize interchangeability.

Figure 3:
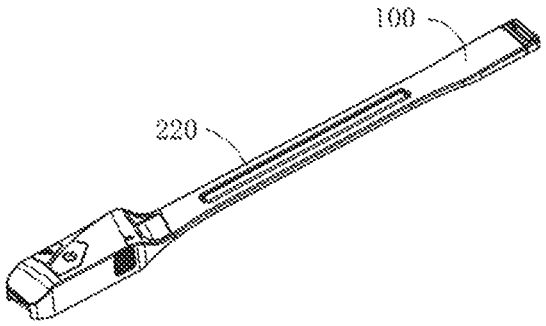
FIG. 3 is a three-dimensional schematic diagram of the straightened body and control assembly in FIG. 1 in one direction.
Figure 4:
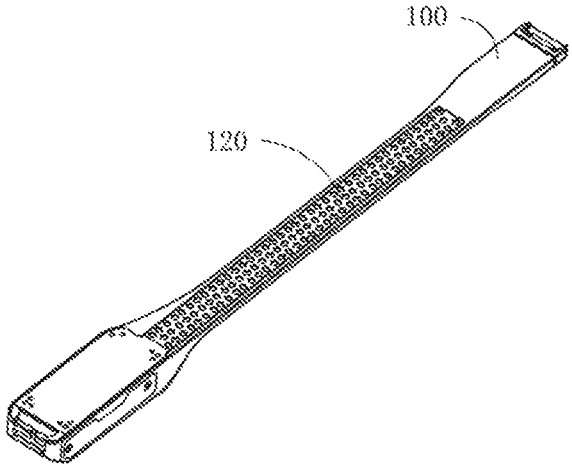
FIG. 4 is a three-dimensional schematic diagram of the straightened body and control assembly in FIG. 1 in another direction.
Figure 5:
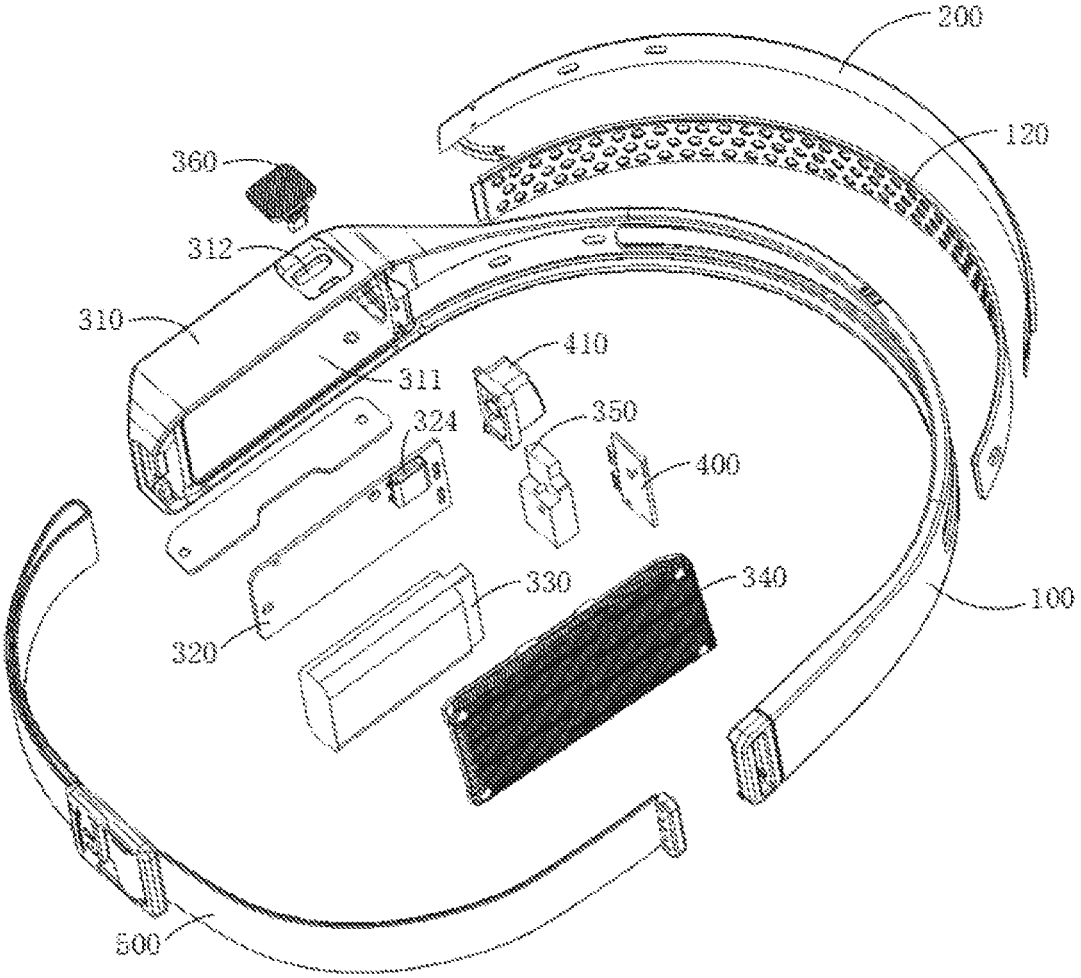
FIG. 5 is a schematic exploded diagram of the body and the control assembly in FIG. 1 in another direction.
Figure 6:
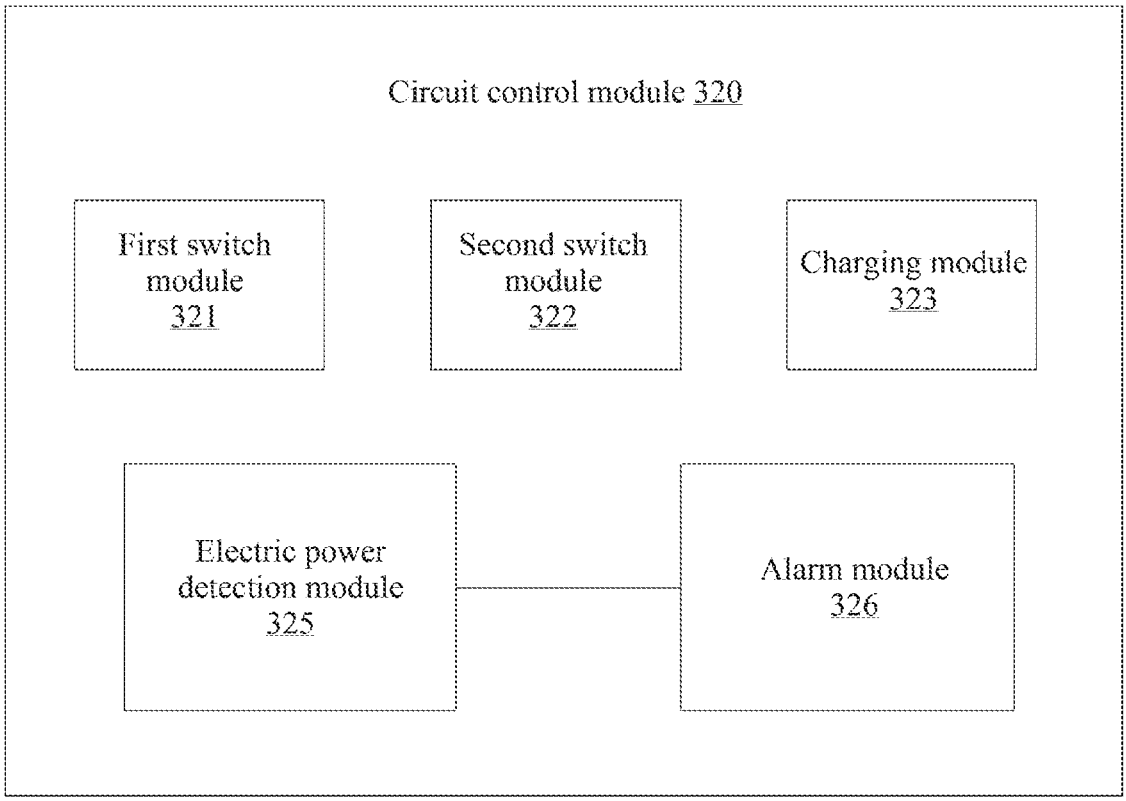
FIG. 6 is a diagram of a circuit control module in FIG. 2.

The second light source 400 is arranged on one side of the installation space 311 that is close to the light-transmitting hole. In order to prevent the second light source from being exposed to the installation housing, the wearable illumination apparatus is further provided with a lens 410 at the light-transmitting hole. Preferably, the second light source 400 is a LED point light source with high-brightness, the light of the point light source is concentrated, and the light intensity in an illumination area is strong, which is suitable for long-distance illumination. Referring to FIG. 3 and FIG. 4, when the installation housing and the body are in a straight state, the direction of the light emitted by the second light source 400 is consistent with an extending direction of the body 100. The second light source 400 can be used for long-distance illumination; and moreover, the second light source can cooperate with the first light source 200 to further expand an illumination range of the illumination apparatus.

The circuit control module 320 is provided with a first switch module 321, one end of the first switch module is connected to the first light source 200, and the other end is connected to the power supply 330. That is, the power supply 330 is indirectly connected to the first light source 200 by means of the first switch module 321, to provide electric energy for the first light source. The first switch module is used for controlling on and off of a working circuit of the first light source 200.

The circuit control module 320 is further provided with a second switch module 322, one end of the second switch module is connected to the second light source 400, and the other end is connected to the power supply 330. That is, the power supply 330 is indirectly connected to the second light source 400 by means of the second switch module 322, to provide electric energy for the second light source. The second switch module is used for controlling on and off of a working circuit of the second light source 400.

Further, since the second light source 400 produces a great amount of heat in the working process, in order to prevent use experience of the user from being affected by the heat, the wearable illumination apparatus is further provided with the heat dissipation module 350. The heat dissipation module 350 is arranged in the above installation space 311 and is in contact with the second light source 400, so that the wearable illumination apparatus can realize heat dissipation of the second light source 400 by means of the heat dissipation module 350. The material of the heat dissipation module 350 is preferably a metal. In this embodiment, the heat dissipation module 350 is an aluminum plate. The aluminum plate has good thermal conductivity and strong heat dissipation performance; and moreover, the overall quality of the aluminum plate is light, which contributes to making the overall apparatus lighter in terms of weight.

To prevent a case in which the user needs to repeatedly change the power supply, the power supply 330 is an accumulator, and furthermore, the wearable illumination apparatus further comprises a charging module 323 and a charging contact 324 that are used for charging the accumulator. In this embodiment, the charging module 323 is integrated on the circuit control module 320, and is electrically connected to the power supply 330, the charging contact 324 is connected to the charging module 323, and the installation housing 310 is provided with a charging hole 312 at a position corresponding to the charging contact, so that the charging contact can be communicated to the outside. When the charging contact is communicated the outside, an external charging apparatus can charge the power supply 330 by means of the charging contact. Preferably, the charging contact is at least partially arranged in the charging hole.

Preferably, the wearable illumination apparatus further comprises the dustproof plug 360, and implements communication and isolation between the charging contact and the outside by means of the dustproof plug 360. Specifically, the installation housing 310 is provided with a fixing hole at a position close to the charging hole 312, one end of the dustproof plug 360 is embedded into the installation space 311 through the fixing hole, an overall dimension of the end is greater than that of the fixing hole, and the other end of the dustproof plug 360 is arranged at the charging hole 312. The dustproof plug 360 is detachably installed at the charging hole. The charging hole 312 can realize the communication between the charging contact 324 and the outside by means of pulling out or snap-fitting of the dustproof plug 360, and in the process of opening the charging hole 312, the part of the dustproof plug 360 that is embedded into the installation space 311 does not come off the installation housing 310; and moreover, when the dustproof plug 360 is snap-fitted with the above charging hole, a certain degree of waterproof and dustproof effect is achieved.

Furthermore, when electric power of the wearable illumination apparatus is extremely low, in order to make the user know the electric power and remind the user to charge in time, the wearable illumination apparatus is further provided with an electric power detection module 325 and an alarm module 326, and the alarm module and the electric power detection module are both integrated on the circuit control module 320. The electric power detection module 325 is connected to the power supply 330, and is used for detecting electric power of the power supply 330. The alarm module 326 is connected to the electric power detection module 325, and can send prompt information about remaining electric power according to a result acquired by the electric power detection module.

In an example, when the electric power of the power supply 330 is lower than a preset value, the electric power detection module 325 can detect the electric power of the power supply, and the alarm module 326 sends out a preset prompt sound based on the result, so as to remind the user to charge. In other examples, the alarm module can further acquire information acquired by the electric power detection module and play a prompt sound about the remaining electric power each time the user activates and uses the wearable illumination apparatus, so that the user can arrange work or life, for example, when the alarm module indicates that there is only 20% of electric power remained, the user can select the distance of the trip or decide whether to go out or not according to the electric power.

The two ends of the fixing band 500 are respectively connected to one end of the control assembly 300 that is far away from the body 100 and one end of the body 100 that is far away from the control assembly 300, and the fixing band itself has a certain elasticity. The fixing band 500, the control assembly 300, and the body 100 enclose an elastic circular structure, and therefore the wearable illumination apparatus can be tightly fixed to the head of the user. The fixing band 500 can be made of materials selected from silica gel, an elastic band, and the like. Since the silica gel has a better skin affinity, the silica gel is preferably selected in this embodiment.

It should be understood that, the fixing band 500 is not necessary, when the body 100 is long enough, one end of the control assembly 300 (specifically, the installation housing 310) that is away from the body and one end of the body 100 that is away from the control assembly can be provided with an adapted engaging portion for fixedly forming into a circular structure by means of engaging.

Headlamps currently on the market generally comprises a main lamp and an elastic band, and two ends of the elastic band are respectively connected to two ends of the main lamp. When the headlamp is worn, the main lamp and the elastic band form a circular structure that is tightly placed around the head of a user. However, the two ends of the elastic band of the headlamp are usually forcibly pulled to deformation because the main lamp is relatively heavy while the elastic band is extremely light, thereby having a bad overall fixing effect. In contrast, the wearable illumination apparatus uses a body and an installation housing that are made of silica gel, the weight thereof is evenly distributed, and the wearable illumination apparatus is closely attached to the head of the user, which solves a technical problem that the conventional headlamp has a bad wearing effect.

A further difference from common headlamps currently on the market lies in that the wearable illumination apparatus is provided with a first light source that is bendable, and a floodlight is selected for the first light source. When the wearable illumination apparatus is worn, the body can be bent into the contour shape of the head of the user, and closely attached to the head with the assistance of a fixing band, and in this case, the first light source is synchronously bent to form a arc-shaped light source. Therefore, the wearable illumination apparatus provides a wider illumination range than those of the headlamps on the market, and the user does not need to repeatedly adjust the angle of the main lamp to make an illumination area of the main lamp be within a desired range by the user, thereby facilitating use of the user. The first light source and the second light source can respectively satisfy short-distance illumination and long-distance illumination when used alone, and can realize a larger illumination view when the two light sources work at the same time.

In addition, because the silica gel itself has a good waterproof performance, the illumination apparatus also has a good waterproof performance.

It should be finally noted that, the above embodiments are merely used for illustrating rather than limiting the technical solution of the present invention; with the concept of the present invention, the technical features in the above embodiments or different embodiments can also be combined, steps can be implemented in any order, many other changes can be made to different aspects of the present invention as described above and are not provided in detail for simplicity; although the present invention is illustrated in detail with reference to the foregoing embodiments, persons of ordinary skill in the art should understand that they can still make modifications to the technical solution recorded in the foregoing embodiments or make equivalent replacements on some of the technical features thereof; and the modifications or replacements do not make the essence of corresponding technical solutions depart from the scope of the technical solution of the embodiments of the present invention.

What is claimed is:

1. A wearable illumination apparatus, comprising:

a body, the body being bendable; and a first light source fixed to the body and is bendable together with the body adaptively;

wherein the wearable illumination apparatus further comprises a control assembly arranged at one end of the body; the control assembly comprises a first switch module, a second switch module and a power supply; the first switch module is connected to the power supply and the first light source respectively, and the second switch module is connected to the power supply and the second light source respectively; and the wearable illumination apparatus further comprises a fixing band; two ends of the fixing band are respectively connected to one end of the control assembly away from the body and one end of the body away from the control assembly.

2. The wearable illumination apparatus of claim 1, wherein the first light source is a floodlight.

3. The wearable illumination apparatus of claim 1, wherein the apparatus further comprises a second light source arranged at one end of the body.

4. The wearable illumination apparatus of claim 1, wherein the control assembly further comprises a charging module and a charging contact; the charging module is connected to the power supply and the charging contact respectively.

5. The wearable illumination apparatus of claim 4, wherein the control assembly further comprises an installation housing, a sealing cover, and a dustproof plug; one end of the installation housing is connected to the body;

the sealing cover covers one face of the installation housing away from the first light source, and an installation space is formed between the sealing cover and the installation housing;

the power supply, the charging module, and the charging contact are arranged in the installation space, and the installation housing is provided with a charging hole communicated with the outside at a position corresponding to the charging contact; and the dustproof plug is detachably installed at the charging hole.

6. The wearable illumination apparatus of claim 1, wherein the control assembly further comprises an alarm module and an electric power detection module for detecting electric power of the power supply; the alarm module is connected to the electric power detection module and prompts the electric power of the power supply according to a detection result of the electric power detection module.

7. The wearable illumination apparatus of claim 6, wherein the control assembly further comprises a heat dissipation module for dissipating heat for the second light source.

8. The wearable illumination apparatus of claim 1, wherein a material of the body is silica gel.

* * * * *